United States Patent [19]

Quarve

[11] Patent Number: 4,616,982

[45] Date of Patent: Oct. 14, 1986

[54] SUBMERSIBLE HIGH PRESSURE PUMP

[75] Inventor: Vernon K. Quarve, Minneapolis, Minn.

[73] Assignee: Graco Inc., Minneapolis, Minn.

[21] Appl. No.: 661,944

[22] Filed: Oct. 17, 1984

[51] Int. Cl.[4] ..... F04B 43/06

[52] U.S. Cl. ..... 417/383; 60/594; 417/387; 417/388

[58] Field of Search ..... 417/383, 385, 386, 387, 417/388, 389; 60/533, 594; 92/60.5, 101; 74/583

[56] References Cited

U.S. PATENT DOCUMENTS

| | | | |
|---|---|---|---|
| Re. 29,055 | 11/1976 | Wagner | 417/388 |
| 2,807,215 | 9/1957 | Hawyhurst | 417/388 |
| 3,161,139 | 12/1964 | Borelli | 417/385 X |
| 3,311,266 | 3/1967 | Ward | 222/146 |
| 3,317,141 | 5/1967 | Mann | 417/388 X |
| 3,623,661 | 11/1971 | Wagner | 239/127 |
| 3,788,554 | 1/1974 | Guise | 417/395 X |
| 3,957,399 | 5/1976 | Siczek | 417/387 |

FOREIGN PATENT DOCUMENTS

| | | | |
|---|---|---|---|
| 1054841 | 4/1959 | Fed. Rep. of Germany | 60/533 |
| 702868 | 4/1931 | France | 60/533 |

*Primary Examiner*—Leonard E. Smith
*Attorney, Agent, or Firm*—Paul L. Sjoquist

[57] ABSTRACT

A submersible pumping unit having a diaphragm pumping chamber connected to one end of an elongated tube, the interior of the tube being filled with hydraulic oil and a reciprocable solid of like density, the other end of the tube being connected to an oil chamber including a reciprocable piston for developing hydraulic pressure and flow oscillations at a predetermined frequency, wherein the hydraulic pressure and flow oscillations are transferred via the tube and the solid in the tube to the diaphragm pumping chamber for pumping the liquid in which the diaphragm pumping chamber is submersed.

13 Claims, 4 Drawing Figures

SUBMERSIBLE HIGH PRESSURE PUMP

BACKGROUND OF THE INVENTION

The present invention relates to diaphragm pumping apparatus, and more particularly to a diaphragm pump of the submersible type wherein the diaphragm pumping chamber is remotely positioned from its hydraulic driving element.

Submersible pumps have considerable utility in the art of pumping, chiefly because they are self-priming and more efficient than suction feed pumps, and can be actuated to provide immediate delivery of the liquid in which they are immersed. Continuous immersion of the pump in the liquid eliminates the need for periodic cleaning of the pump components, for so long as the liquid level is maintained above the elevation of the pump the effects of air drying are eliminated. These features have particular application and utility in the field of paint spray painting, particularly when painting from containers having predetermined volumes of paint. For example, paint is commercially available in one gallon and five gallon containers, and it is advantageous to provide a pumping apparatus which is conveniently adaptable to containers of these sizes for applying the liquid contained therein.

U.S. Pat. No. 3,317,141, issued May 2, 1967, shows an airless spray gun coupled to a tubular diaphragm paint pump immersed in a container of paint, wherein the tubular diaphragm is alternately contracted and expanded by the application of pressurized oil delivered from a reciprocating oil pump coupled to the outside walls of the tubular diaphragm, by means of a hose or tube intermediate the diaphragm pump and the reciprocating oil pump. This pump has a disadvantage in that it requires manual priming under certain conditions of operation, and further in that it utilizes a relatively complex construction to accomplish the pumping operation.

U.S. Pat. No. 3,623,661, issued Nov. 30, 1971, shows another form of diaphragm pump which is itself not immersed in the liquid, but is connected via an elongated tube to a filter which is immersed in the liquid. This device also suffers from the disadvantage that it requires a bypass flow connection for priming the pump, thereby requiring certain preliminary steps to be taken before pumping can be accomplished with the system.

U.S. Pat. No. 3,788,554, issued Jan. 29, 1974, shows a diaphragm pump which is immersed into a liquid container wherein the diaphragm is driven by a hydraulic oil column coupled through an elongated tube to one side of the diaphragm, the other end of the tube being coupled into a reciprocating piston chamber. The piston develops a reciprocating pressure pulse in the hydraulic oil in the tube which causes the diaphragm to move in correspondence and thereby to pump liquid from the container. Air entrainment in the hydraulic oil of the tube, or a tube of excessive length or volume, can cause this pump to operate inefficiently or even to become inoperative, if the reciprocating pulses developed by the piston into the oil are absorbed into the air and are not readily transmitted to the diaphragm pumping chamber.

There is a need for a submersible diaphragm pump which can efficiently pump liquids from a container to minimize the problem of air entrainment in the hydraulic driving oil and irrespective of the length or volume of the tubular column of hydraulic oil which extends between the diaphragm pump and the driving piston mechanism. The present invention meets this need according to the teachings which will become apparent from the specification and claims.

SUMMARY OF THE INVENTION

The invention comprises a submersible diaphragm pump including a reciprocating drive mechanism supported on legs at a height which is higher than the height of a liquid container from which pumping is to be accomplished. A reciprocating piston is coupled into an oil chamber which is connected to a downwardly suspended hollow tubular member having a diaphragm pumping element at its lower end. The hollow tubular member is substantially filled with a freely longitudinally movable solid, or a plurality of solid segments, having approximately the same density as the hydraulic oil contained therein. The diaphragm pumping element contains an inlet check valve for admitting liquid into a pumping chamber, and an outlet check valve for permitting the one-way flow of liquid pumped from the chamber, and fluid delivery line for delivering the pumped liquid to a spray gun or the like.

It is a principal object of the present invention to provide a submersible diaphragm pump which may be efficiently operated to pump a wide variety of liquids from a number of different container sizes.

It is another object of the present invention to provide a submersible diaphragm pump which is hydraulically coupled to a driving piston through an elongated column of oil, and wherein a substantial volume is occupied by an incompressible solid which cannot entrain air or gases, whereby air entrainment in the limited oil volume does not degrade the performance of the pump.

It is yet another object of the present invention to provide a hydraulically driven diaphragm pump through an elongated oil column, wherein compressibility of the oil in the column is significantly reduced by virtue of a solid or solids occupying a substantial volume in the oil column.

DESCRIPTION OF THE DRAWINGS

The foregoing objects and advantages will become apparent from the following specification and claims, and with reference to the appended drawing, in which:

DESCRIPTION OF THE PREFERRED EMBODIMENT

Figure 1:
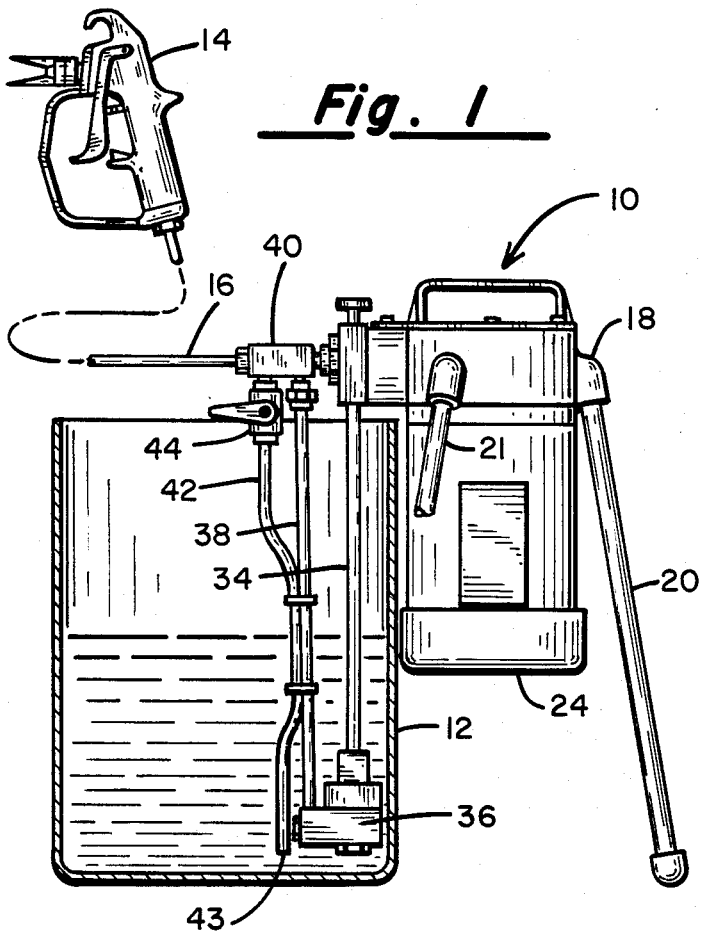
FIG. 1 shows a side elevation view of the invention in partial cross section.
Figure 2:
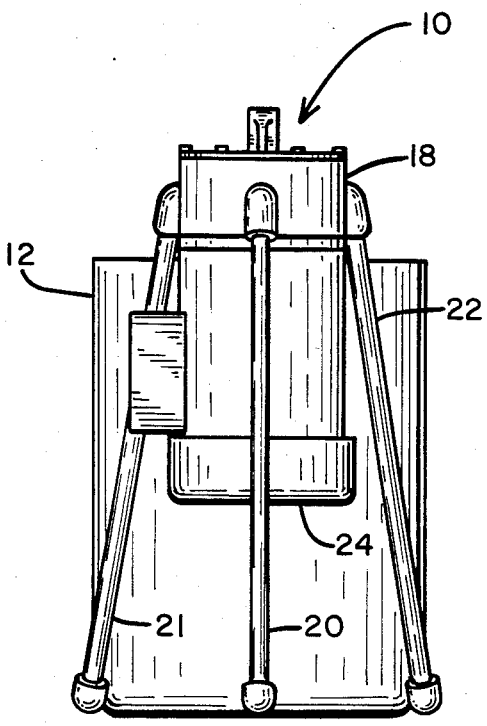
FIG. 2 shows an end elevation view.

Referring first to FIGS. 1 and 2, there is shown the invention in elevation end view (FIG. 2) and in elevation side view in partial cross section (FIG. 1). Pump 10 is supported in an elevated position on legs 20, 21, 22, which are attached to a housing 18. In operation, pump 10 is positioned adjacent a container 12 which is typically filled with paint or like liquid. Pump 10 is connected to a spray gun 14 or the like, via a delivery hose 16. A rotary drive source 24, which may be an electric motor or other equivalent driving mechanism, is attached to housing 18. To improve stability, motor 24 is shown suspended from the bottom of housing 18, although an alternative mounting may be used wherein motor 24 is mounted atop housing 18.

A motor shaft 26 (FIG. 4) projects into the interior of housing 18 via a suitable bearing and liquid seal. An eccentric drive 28 is attached to motor shaft 26, and is operatively connected to piston 30 so that rotation of shaft 26 causes eccentric drive 28 to reciprocate piston 30 along a horizontal axis. The inside of housing 18 is enclosed to form a chamber 32, which is preferably filled with hydraulic oil. The oil in chamber 32 is in flow coupling relationship to the interior of a hollow tube 34, which is attached at its upper end to housing 18 and at its lower end to a diaphragm pump 36. Diaphragm pump 36 has an outlet delivery line 38 connected to a manifold 40, which in turn is connected to delivery hose 16. A bypass line 42 is also connected to manifold 40 via a valve 44, and is returned to the interior of container 12 through open end 43.

Figure 3:
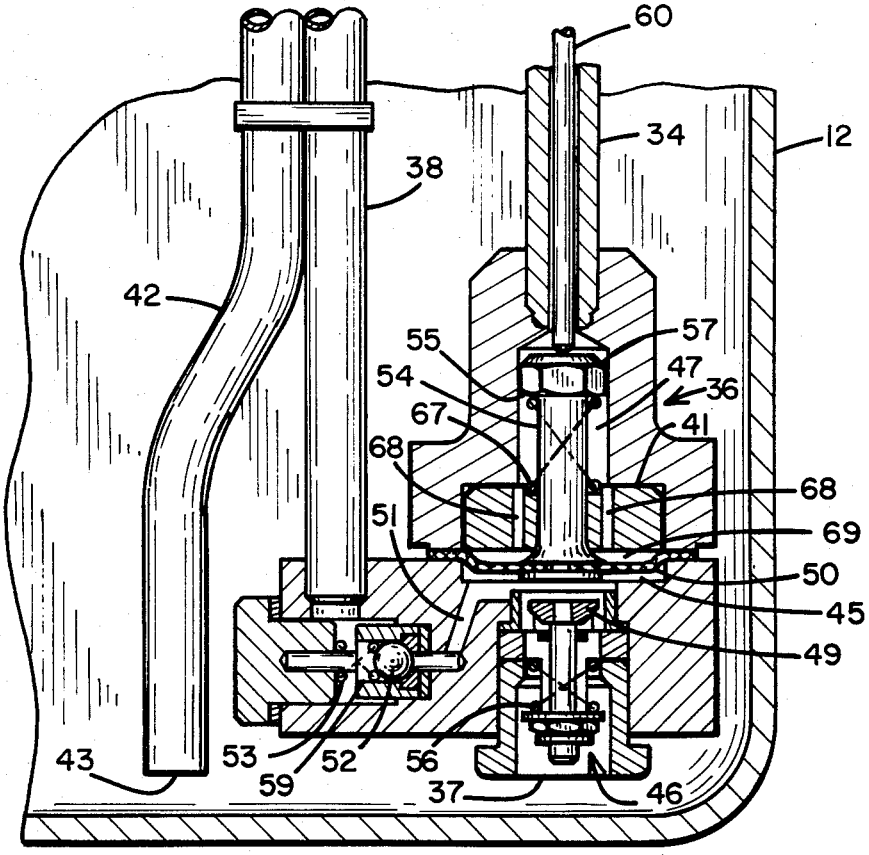
FIG. 3 shows an expanded cross sectional view of the diaphragm pumping element.

FIG. 3 shows a cross-sectional view of diaphragm pump 36, which is typically immersed in the liquid within container 12. Diaphragm pump 36 is attached to tube 34 and is suspended therefrom at a position which is relatively close to the bottom of container 12. An inlet 37 has in association therewith a check valve 46. Check valve 46 has a valve shoulder 49 which may be raised from contact with its seat against the face of spring 56 to permit the flow of liquid into chamber 45. Chamber 45 is in flow contact with a diaphragm 50, such that upward movement of diaphragm 50 tends to draw liquid into chamber 45 via inlet 37, and downward movement of diaphragm 50 tends to force liquid to be expelled from chamber 45. A passage 51 is in flow communication between chamber 45 and outlet check 52. Outlet check 52 is spring biased against a seat by means of compression spring 53, to permit one-way flow of liquid from passage 51 to outlet delivery line 38 whenever the pressure forces developed inside of chamber 45 exceed the spring force of spring 53. Flow passages are provided about outlet check 52 in valve body 59, to permit the free flow of liquid through passage 51 and into outlet delivery line 38 whenever outlet check 52 is unseated.

An oil chamber 47 is formed in a cavity above diaphragm 50, oil chamber 47 being in fluid flow communication with the interior of tube 34. Diaphragm 50 is attached to a spool 54 which is directed generally upwardly in oil chamber 47. Spool 54 has an upper shoulder 55, and a compression spring 67 is seated against shoulder 55 to bias spool 54 and diaphragm 50 in an upward direction. Shoulder 55 is preferably formed by one side of a hexagonal nut 57 which is threadably attached to spool 54 The flat surfaces of hexagonal nut 57 permit the free passage of oil between oil chamber 47 and the region above hexagonal nut 57 which opens into the lower end of tube 34. Spool 54 is slidably fitted through a spacer block 41, and the lower end of spool 54 is attached to diaphragm 50. Spacer block 41 has a plurality of passages 68 therethrough to permit the free flow of oil into diaphragm chamber 69 from chamber 47, and the return flow from chamber 69 to chamber 47.

A rod 60 is inside tube 34, and has a cross section area which is slightly less than the internal cross-sectional opening of tube 34. Rod 60 is freely slidable inside of tube 34, and is unattached at both of its ends. Further, rod 60 extends through a predetermined length of tube 34. The lower end of rod 60 faces toward the upper region of oil chamber 47, and the upper end of rod 60 faces toward the lower region of oil pumping chamber 58, above tube 34. As an alternative to rod 60 there may be selected any solid material which is incompressible and which occupies substantially the equivalent volume of rod 60 within tube 34. For example, a plurality of spherical solid balls may be inserted into tube 34 to substantially fill the length of tube 34. As a further example, rod 60 may be replaced by a plurality of smaller rod segments which substantially fill the length of tube 34. It is desirable to leave a portion of the length of tube 34 unfilled with solid material. The length of tube 34 which should be unfilled with solid material may be determined by calculating the volumetric displacement of piston 30 over its stroke, and then calculating the length of tube 34 which is required to equal this volumetric displacement. It is this length of tube 34 which should remain unfilled with any solid material, to enable the full discharge of oil displaced by piston 30 to be discharged into tube 34 during the pressure stroke of piston 30, without requiring relative oil flow in the small annular clearance between rod 60 and the inner walls of tube 34. During the return stroke of piston 30 this same volume of oil is returned into the piston driving chamber, resulting in the reciprocation of rod 60 in tube 34 over a distance equal to the displacement of the oil volume in tube 34. It is preferable that the material selected for rod 60, or for any equivalent solid material placed in tube 34, have a density substantially the same as the density of the oil used in the pumping system. For example, in the preferred embodiment, the oil density is 0.870 grams per cubic centimeter ($gm/cc^3$), and the material chosen for rod 60 is polyethylene plastic, which has a density of 0.910 $gm/cc^3$. The similarity of oil density and rod density allows for the condition wherein the rod becomes nearly suspended in the oil, and is therefore freely reciprocable in tube 34 by the influence of the oil flow forces acting against the upper and lower ends of the rod during operation.

During the pressure stroke of piston 30 an oil pressure in the range of 2,000–3,000 pounds per square inch (PSI) may be developed in oil pumping chamber 58. This high pressure creates a downward force against rod 60, and a downward oil flow and movement of rod 60 causes a corresponding pressure to be developed in diaphragm chambers 47 and 69. These pressures cause downward deflection of diaphragm 50, which forceably ejects liquid from chamber 45 into outlet passage 51. During the suction stroke of piston 30 the pressure in chamber 58 is reduced to below a pressure close to atmospheric pressure, and the corresponding downward force against rod 60 is removed. An upward force is created by the force of spring 57 acting against spool 54, and the normal atmospheric pressure on the liquid in container 12 which is dispensed in chamber 45 by the release in check valve 46. These forces combine to raise diaphragm 50 upwardly, and to upwardly reciprocate rod 60 in tube 34. It should be noted that the density of rod 60 is selected to be similar to the density of oil, and therefore the lifting force required to raise rod 60 is nearly identical to the corresponding pressure force which would otherwise cause upward flow of oil in tube 34. Since the rod 60 is a solid having nearly the same weight per unit volume as oil, and since the rod 60 is freely movable in the column of oil, it is easily moved upwardly in response to the forces present in the diaphragm pump, in the same degree as if a pure column of oil existed in tube 34. Further, since rod 60 is a solid material the usual problems of air entrainment in oil which adversely affects the compressibility of the oil and its ability to transmit fluid forces, the pump operates over a wider range of pressure conditions than would otherwise be possible with a simple oil column in tube 34. As has been noted herein, rod 60 may be replaced by other forms of solids, as for example a plurality of spheres, a plurality of rod segments, or other equivalent solid materials. In such cases it may be possible to incorporate a curved column in substitution of tube 34 which is shown to be straight in the drawings.

Figure 4:
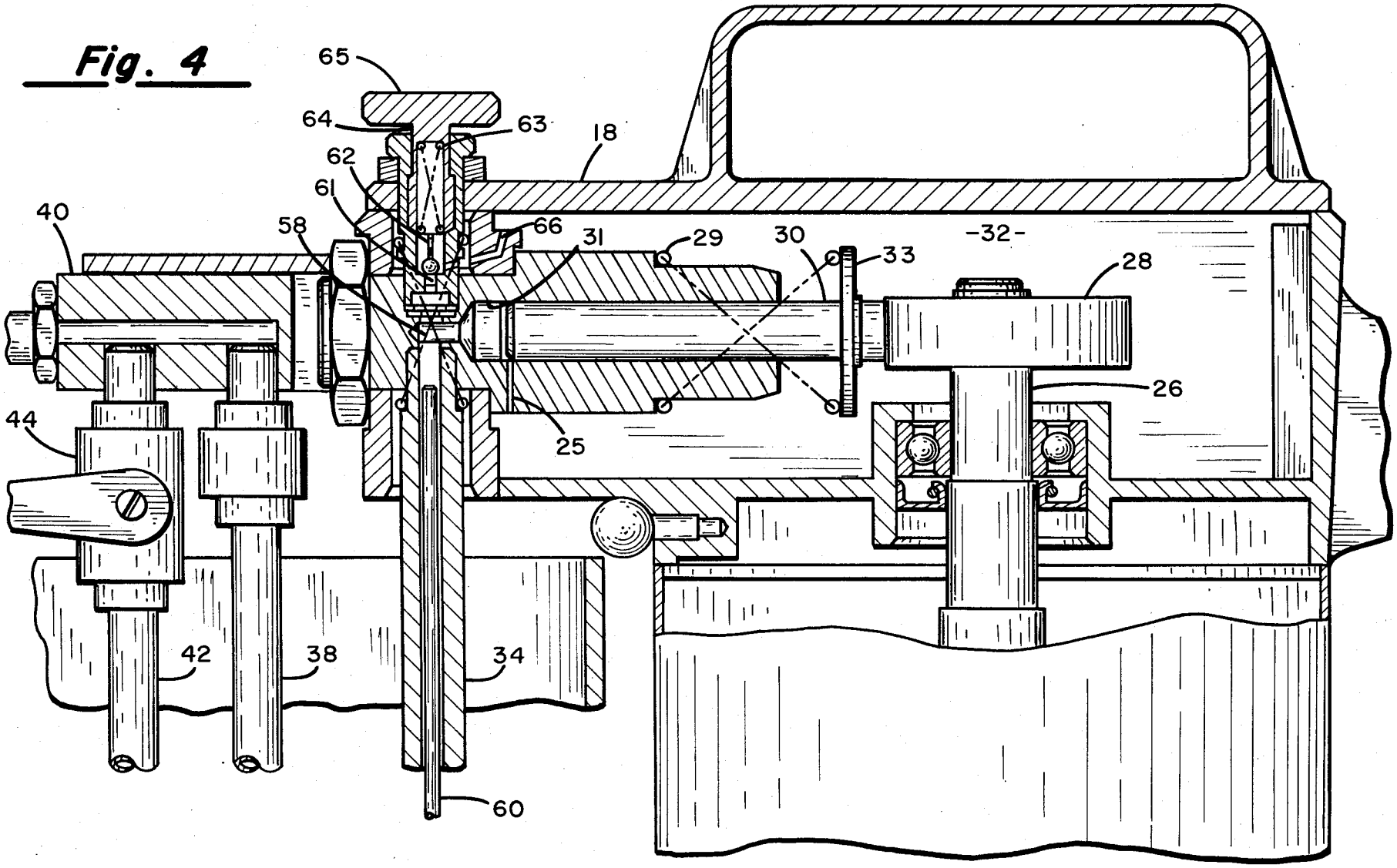
FIG. 4 shows an expanded cross section view of a portion of the hydraulic pumping system.

FIG. 4 shows an enlarged cross-sectional view of housing 18 and components associated therewith. Housing 18 is preferably constructed from cast aluminum or other similar material, and has an oil tight interior so as to form oil chamber 32. Motor shaft 26 projects into chamber 32 through a suitable bearing and oil seal, and is fixedly attached to eccentric drive 28. Eccentric drive 28 contacts an end of piston 30, and piston 30 is spring biased toward eccentric drive 28 by means of compression spring 29. Compression spring 29 is seated between an inside wall of housing 18 and a cap 33 which is affixed to piston 30. Piston 30 is reciprocable within a cylinder 31 which is sized large enough to permit slidable motion therein by piston 30. The end of piston 30 faces oil pumping chamber 58, which is in flow communication with the upper interior opening of tube 34.

A relief valve 62 also communicates with oil pumping chamber 58 through a suitable passage 61. Relief valve 62 is spring biased toward passage 61 by means of spring 63, which is constrained between valve 62 and a threadable shaft 64. Shaft 64 may be threadably moved inwardly and outwardly by means of knob 65, so as to increase or decrease the compression force of spring 63, and thereby increase or decrease the pressure required to open valve 62. A relief passage 66 is coupled between valve 62 and chamber 32, to provide a flow bypass for oil which may be diverted through the opening of valve 62. Relief valve 62 is threadably adjusted by means of knob 65 to a preset pressure level. Whenever the pressure of the hydraulic oil in oil pumping chamber 58 exceeds this preset pressure threshhold, valve 62 will move upwardly and open passage 66 into chamber 58. Oil may then flow from chamber 58, through passage 61 and passage 66, into chamber 32 to thereby bleed off excess pressure. Knob 65 may be therefore identified as an upper pressure setting valve for setting the maximum pressure under which the pump may operate. An oil replenishing passage 25 opens into cylinder 31 at a point just forward of the rearmost position of piston 30. Replenishing passage 25 also opens into chamber 32, and therefore provides a flow passage for oil to the interior of cylinder 31 during each return stroke of piston 30, which oil is supplied from the oil resevoir of chamber 32.

Valve 44 is provided as a pressure bleed-off valve, enabling pressurized liquid which may be trapped between manifold 40 and spray gun 14 to be drained back to container 12. Valve 44 has a manual setting which provides fluid flow coupling from manifold 40 to bypass line 42. When valve 44 is turned off this bypass is closed and allows pressurized liquid from delivery line 38 to be coupled via manifold 40 into delivery hose 16.

In operation, it is to be presumed that pump 10 is set up adjacent to a container filled with liquid to be sprayed, and diaphragm pump 36 is immersed in the liquid. The spring force of inlet check valve 46 is set to be very light, and liquid therefore is permitted to enter chamber 45 really by virtue of the pressure forces acting in the lower portion of the container 12. Chamber 45 therefore becomes at least partially filled with liquid as a result of these pressure forces, which enables the self-priming of diaphragm pump 36. When the electric motor is energized there immediately is generated a reciprocating motion of piston 30, resulting in oil pressure and flow fluctuations in oil chamber 58. These oil pressure and flow fluctuations are coupled into tube 34 and act upon rod 60 to cause it to reciprocate with the oil in tube 34. The immediate reciprocation of rod 60 transfers these pressure and flow forces downwardly to oil chamber 47 and oil chamber 69 in diaphragm pump 36. The oil pressure variations in chambers 47 and 69 cause reciprocation of diaphragm 50 against the force of spring 67. Reciprocation of diaphragm 50 causes alternating suction and compression forces in chamber 45, thereby drawing liquid into inlet 37 and expelling liquid out of outlet passage 51. Inlet valve 46 and outlet valve 52 act accordingly, permitting the one-way transfer of pressurized liquid from container 12 into outlet delivery line 38. The liquid is thereafter pumped through outlet delivery line 38 and manifold 40 into hose 16, and ultimately to spray gun 14. If spray gun 14 is not actuated to release the pressurized liquid developed therein, a pressure buildup will be developed all the way back into chamber 45 of diaphragm pump 36. This pressure will be sensed as a back pressure developed in the hydraulic oil circuits associated with the hydraulic pumping mechanism, causing reciprocation of oil flow and of rod 60 to cease and developing an increased pressure in oil chamber 58. When this oil pressure in chamber 58 becomes sufficiently high to cause relief valve 62 to become moved to expose relief passage 66, the excess pressure will be relieved by means of oil passing back into oil reservoir 32. Pressures within the system will become stabilized at that point, and until spray gun 14 is actuated to release the pressure developed therein. At that point, pressurized liquid will be passed from spray gun 14, and valve 62 will close to block the relief passage, and to permit reciprocating oil pressures to once again develop in chamber 58. This again causes rod 60 in the oil column to reciprocate to develop the necessary diaphragm pump action to continue the flow of liquid through the system.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A submersible high pressure pump and hydraulic pump driving system, comprising:

(a) a submersible pump head including an interior volume separated into two chambers by a diaphragm membrane, one of said chambers being a liquid pumping chamber and the other chamber being an oil chamber, and including inlet and outlet check valves in said liquid pumping chamber;

(b) a reciprocable piston and cylinder assembly, including an oil pumping chamber, said cylinder opening into said oil pumping chamber; said reciprocable piston and cylinder assembly being elevated above and spaced apart from said submersible pump head;

(c) an elongated tube connected between said oil pumping chamber and said oil chamber; whereby said pump head may be immersed in liquid and said piston and cylinder assembly may be spaced away from immersion in liquid; and (d) an incompressible solid in said tube, said solid sized to occupy substantially the entire volume of a predetermined length of said tube, said length being determined by subtracting from the total length of said tube the length of a volume of oil in said tube corresponding to the volumetric displacement of said reciprocable piston, while permitting free reciprocating motion of said solid in said tube; said oil pumping chamber, said elongated tube and said oil chamber being filled with oil.

2. The apparatus of claim 1, further comprising the solid in said tube having approximately the same density as the oil in said tube.

3. The apparatus of claim 2, wherein said solid further comprises a rod having an outside dimension slightly less than said tube inside dimension.

4. The apparatus of claim 1, wherein said diaphragm membrane is spring-biased toward said reciprocable piston and cylinder assembly.

5. The apparatus of claim 4, wherein said reciprocable piston and cylinder assembly is positioned above said submersible pump head, and is connected to said pump head by said elongated tube.

6. The apparatus of claim 5, wherein said tube further comprises a straight section of hollow tubing.

7. The apparatus of claim 6, wherein said solid extends substantially the entire length of said tube, except for a distance in said tube determined by calculating the volumetric displacement of said piston stroke in said cylinder.

8. The apparatus of claim 7, wherein said solid further comprises a rod having an outside dimension slightly less than said tube inside dimension.

9. A high pressure pump in two spaced apart sections having improved pumping capability, comprising:

(a) a first pumping section having a mechanically reciprocable piston and a first oil chamber, and means for alternately pressurizing and depressurizing said first oil chamber by driving said piston through a predetermined volumetric displacement;

(b) a second pumping section having a diaphragm forming a wall of a second oil chamber and also forming a wall of a liquid pumping chamber; said first pumping section being located at an elevated and spaced apart position relative to said second pumping section; and (c) an elongated tube connected between said first and second oil chambers, and a solid material movable in said tube, said solid material occupying substantially the entire volume of a predetermined length of said tube, except a length which defines a volume in said tube which is approximately equal to said piston predetermined volumetric displacement.

10. The apparatus of claim 9, wherein said first pumping section is positioned at an elevation above said second pumping section.

11. The apparatus of claim 9, wherein said tube is of circular internal cross section and said solid material in said tube is of lesser cross section.

12. The apparatus of claim 11 wherein said solid material further comprise an elongated rod.

13. The apparatus of claim 12 wherein said solid material has a density proximate the density of oil.

* * * * *